US008845180B2

(12) United States Patent
Huckby

(10) Patent No.: US 8,845,180 B2
(45) Date of Patent: Sep. 30, 2014

(54) SHAKING MACHINE ADAPTOR FOR CONTAINERS HAVING DIFFERENT SHAPES

(75) Inventor: Dwight R. Huckby, Brookpark, OH (US)

(73) Assignee: The Sherwin-Williams Company, Cleveland, OH (US)

( * ) Notice: Subject to any disclaimer, the term of this patent is extended or adjusted under 35 U.S.C. 154(b) by 0 days.

(21) Appl. No.: 13/619,292

(22) Filed: Sep. 14, 2012

(65) Prior Publication Data

US 2013/0242691 A1 Sep. 19, 2013

Related U.S. Application Data

(62) Division of application No. 11/244,205, filed on Oct. 5, 2005.

(60) Provisional application No. 60/616,112, filed on Oct. 5, 2004.

(51) Int. Cl.

| | |
|---|---|
| ***B01F 9/02*** | (2006.01) |
| ***B01F 15/00*** | (2006.01) |
| *B01F 9/00* | (2006.01) |

(52) U.S. Cl.

CPC ..... *B01F 9/003* (2013.01); *B01F 2215/005* (2013.01); *B01F 2009/0087* (2013.01); *B01F 15/0074* (2013.01); *B01F 9/0001* (2013.01); *B01F 2015/00649* (2013.01); *B01F 9/0032* (2013.01); *B01F 9/00* (2013.01); *B01F 2009/0067* (2013.01); *B01F 9/0018* (2013.01); *Y10S 366/605* (2013.01)

USPC ..... 366/217; 366/213; 366/605

(58) Field of Classification Search

CPC ..... B01F 9/0001; B01F 9/003

USPC ..... 366/208, 213, 214, 217, 605

See application file for complete search history.

(56) References Cited

U.S. PATENT DOCUMENTS

| | | | | |
|---|---|---|---|---|
| 2,006,451 | A * | 7/1935 | Glidden | 366/213 |
| 2,624,451 | A | 8/1949 | Ewing | |
| 3,542,344 | A | 11/1970 | Oberhauser | |
| 4,235,553 | A | 11/1980 | Gall | |
| 4,497,581 | A | 2/1985 | Miller | |

(Continued)

FOREIGN PATENT DOCUMENTS

| | | |
|---|---|---|
| DE | 2938561 | 6/1980 |
| EP | 1527814 | 4/2005 |
| SU | 1560290 | 4/1990 |

OTHER PUBLICATIONS

PCT International Search Report, International Application No. PCT/US2005/036111, Feb. 6, 2006.

(Continued)

*Primary Examiner* — David Sorkin

(74) *Attorney, Agent, or Firm* — Daniel A. Sherwin; Robert E. McDonald; Vivien Y. Tsang

(57) ABSTRACT

An adaptor for a vortex paint mixer. The adaptor includes a pair of semi-cylindrical holding structures pivotally connected together by a pair of pivot links. Each of the halves has a depression formed therein. When the holding structures are placed together, the two depressions form a cavity having first and second regions adapted to hold a conventional cylindrical quart paint container and a rectangular quart paint container, respectively.

6 Claims, 9 Drawing Sheets

(56) References Cited

U.S. PATENT DOCUMENTS

| | | | | |
|---|---|---|---|---|
| 4,523,855 | A | 6/1985 | Walker | |
| 5,615,765 | A | 4/1997 | Roericht | |
| 6,530,500 | B2 | 3/2003 | Bravo et al. | |
| 6,767,125 | B2 | 7/2004 | Midas et al. | |
| 6,817,751 | B2 | 11/2004 | Huckby et al. | |
| 6,945,690 | B2 * | 9/2005 | Armendariz et al. | 366/209 |
| 6,953,279 | B2 | 10/2005 | Midas et al. | |
| 6,988,824 | B2 * | 1/2006 | Santospago et al. | 366/217 |
| 7,077,560 | B2 | 7/2006 | Huckby et al. | |
| 7,182,505 | B2 | 2/2007 | Huckby | |
| 7,325,968 | B2 | 2/2008 | Huckby et al. | |
| 7,445,373 | B2 | 11/2008 | Huckby et al. | |
| 2002/0195471 | A1 * | 12/2002 | Nottingham et al. | 222/570 |
| 2003/0107949 | A1 * | 6/2003 | Huckby et al. | 366/217 |
| 2003/0142583 | A1 * | 7/2003 | Santospago et al. | 366/209 |
| 2003/0214876 | A1 * | 11/2003 | Glass | 366/209 |
| 2004/0208083 | A1 * | 10/2004 | Armendariz et al. | 366/209 |
| 2005/0169102 | A1 * | 8/2005 | Manke | 366/209 |

OTHER PUBLICATIONS

PCT International Opinion of the International Searching Authority, International Application No. PCT/US2005/036111, Feb. 6, 2006.

* cited by examiner

FIG. 7
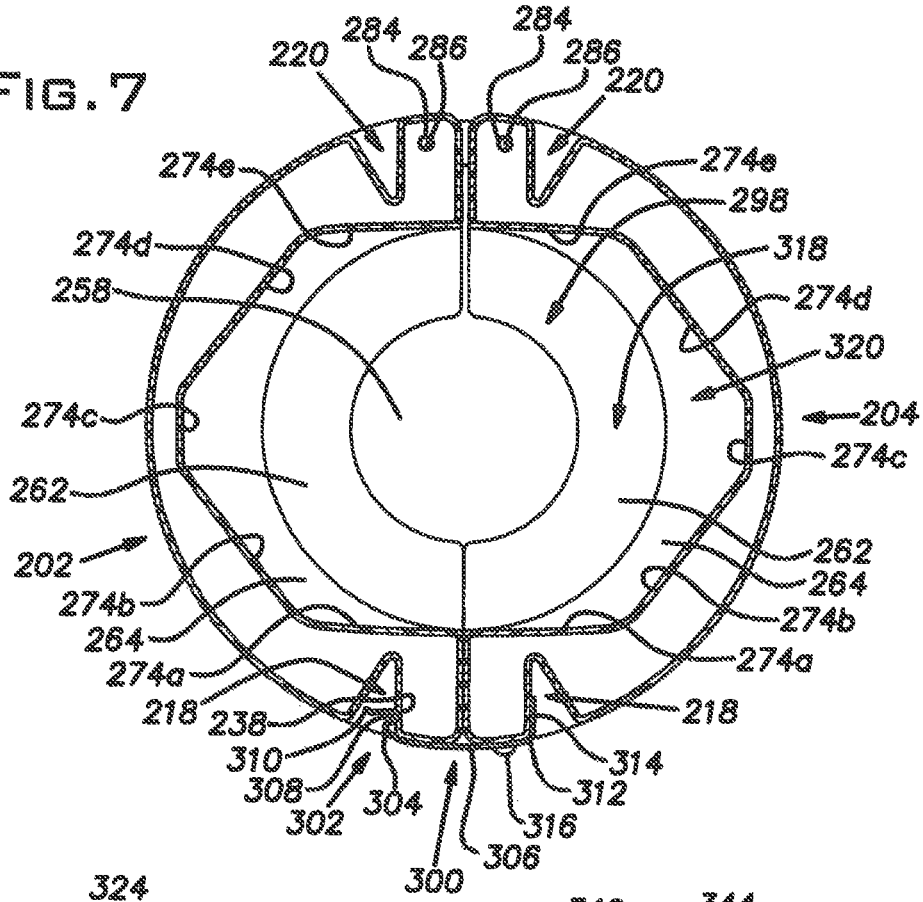
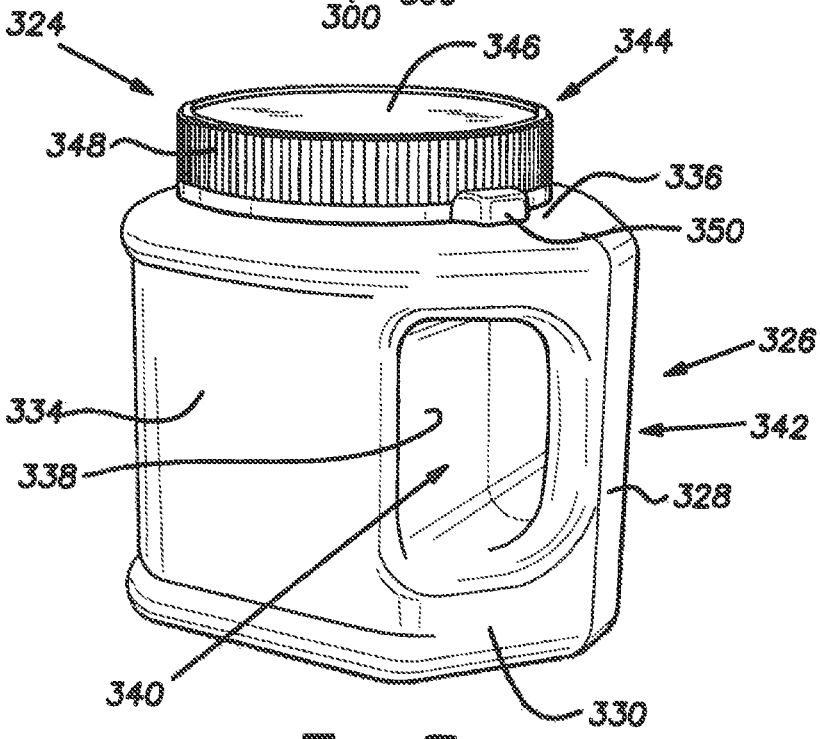
FIG. 8

SHAKING MACHINE ADAPTOR FOR CONTAINERS HAVING DIFFERENT SHAPES

CROSS-REFERENCE TO RELATED APPLICATIONS

This application is a divisional application of U.S. patent application Ser. No. 11/244,205 filed Oct. 5, 2005, which claimed priority from U.S. Provisional Application No. 60/616,112, filed Oct. 5, 2004, the entirety of which applications are hereby incorporated by reference.

The present invention relates to the mixing of fluid dispersions and more specifically to apparatus and methods for mixing paint disposed in containers having different shapes.

As is well known, solids in fluid dispersions, such as paint, tend to settle in a downward direction through the force of gravity. Fluid dispersions disposed in containers for commercial sale are typically mixed in the containers before they are used by the purchasers. Many fluid dispersions can be facilely mixed in a container by manually shaking the container. Other fluid dispersions, however, such as paint, are more difficult to manually mix in a container and, thus, are often mixed in the container using a machine that shakes, rotates, vibrates or otherwise moves the container.

A variety of different types of mixing machines are known for mixing fluid dispersions disposed in containers, One type of mixing machine that is commonly used to shake individual containers of dispersions, such as paint, is known as a vortex mixer. In a vortex mixer, the container holding the dispersion is rotated around at least one axis, Typically, the container is at least. rotated about its own vertical axis, Examples of conventional vortex mixers include those disclosed in U.S. Pat. No. 3,542,344 to Oberhauser, U.S. Pat. No. 4,235,553 to Gall, and U.S. Pat. No. 4,497,581 to Miller, all of which are hereby incorporated by reference. Conventional vortex mixers such as these are constructed to accommodate one particular size and shape of container. For example, vortex mixers for paint are typically constructed to accommodate a conventional one gallon cylindrical container. Since paint is typically also sold in cylindrical quart containers, adaptors have been developed for holding quart containers in these vortex paint mixers. An example of such an adaptor is shown in U.S. Pat. No. 4,497,581 to Miller. The adaptor in the Miller patent is cylindrical in shape and has substantially the same diameter and length as a conventional one gallon paint container. The adaptor includes a pair of semi-cylindrical halves pivotally connected together by a pair of pivot links. Each of the halves has a semi-cylindrical depression formed therein. When the halves are placed together, the two depressions form a cylindrical cavity dimensioned to accommodate a standard size quart paint container.

The vortex paint mixers and adaptors therefor described above are suitable for conventional cylindrical containers. Recently, however, manufacturers have begun to package paint in generally square and rectangular containers. A commercial example of a generally square container is the TWIST & POUR™ container sold by The Sherwin-Williams Company, who is the assignee of the present application. Another example of such a container is disclosed in U.S. Pat. No. 6,530,500 to Bravo et al., which is assigned to The Sherwin-Williams Company.

U.S. Patent Application No. 2003/0107949 ("the '949 application") to Huckby et al., which is incorporated herein by reference and is assigned to the assignee of the present application, disclose vortex mixers that can mix paint in both square and cylindrical one gallon paint containers. The vortex mixers in the Huckby et al. '949 application can accommodate a conventional adaptor for holding cylindrical quart paint containers. Conventional adaptors, however, can only accommodate cylindrical quart paint containers; conventional adaptors cannot accommodate a square or rectangular quart paint container.

Based on the foregoing, there is a need in the art for an adaptor for a vortex mixer that can mix paint in both square and cylindrical one gallon paint containers, wherein the adaptor can accommodate both a cylindrical and square or rectangular quart paint container. The present invention is directed to such an adaptor.

In accordance with the present invention, an adaptor is provided for holding a container having a predetermined width in a bucket of a mixing device. The adaptor has a central longitudinal axis and includes a pair of holding structures connected together for pivotal movement relative to each other along a pivot axis parallel to and spaced from the longitudinal axis. The holding structures move between an open position and a closed position. Each of the holding structures has a plurality of interior surfaces defining an inner depression. These interior surfaces include first and second interior support surfaces disposed in planes perpendicular to the longitudinal axis. The first interior support surface is disposed at a different elevation than the second interior support surface. When the holding structures are in the closed position, the inner depressions cooperate to define a cavity having a first region at least partially defined by the first interior support surface and a second region at least partially defined by the second interior support surface. The first region is adapted to hold the container when the container has a body with a circular cross-section. The second region is adapted to hold the container when the container has a substantially rectangular cross-section. When the adaptor is holding the container and the holding structures are in the closed position, the container is supported on the first interior support surfaces when the container has a circular cross-section, and is supported on the second interior support surfaces when the container has a body with a substantially rectangular cross-section.

Also provided in accordance with the present invention is an apparatus for mixing paint. The apparatus includes a mixing device having a mixing bucket with a base. A retaining structure extends from the base and has at least one interior surface that at least partially defines an interior holding space. An electric motor is connected to the base for rotating the holding structure about at least one axis. An adaptor is disposed in the holding space of the retaining structure and defines a cavity. A container for holding the paint is removably disposed in the cavity of the adaptor. The container has an at least generally rectangular body.

A method of mixing paint is further provided in accordance with the present invention. The method includes placing a cylindrical first container in an adaptor, placing the adaptor in a bucket and then rotating the bucket. The adaptor is then removed from the bucket and the first container is removed from the adaptor. An at least generally rectangular second container is placed in the adaptor, which is then placed in the bucket. The bucket is then rotated.

BRIEF DESCRIPTION OF THE DRAWINGS

The features, aspects, and advantages of the present invention will become better understood with regard to the following description, appended claims, and accompanying drawings where:

FIG. 7 shows a cross-sectional view of the adaptor in the closed position;

FIG. 8 shows a side perspective view of a rectangular paint container that can be held in the adaptor;

DETAILED DESCRIPTION OF THE PREFERRED EMBODIMENTS

Figure 1:
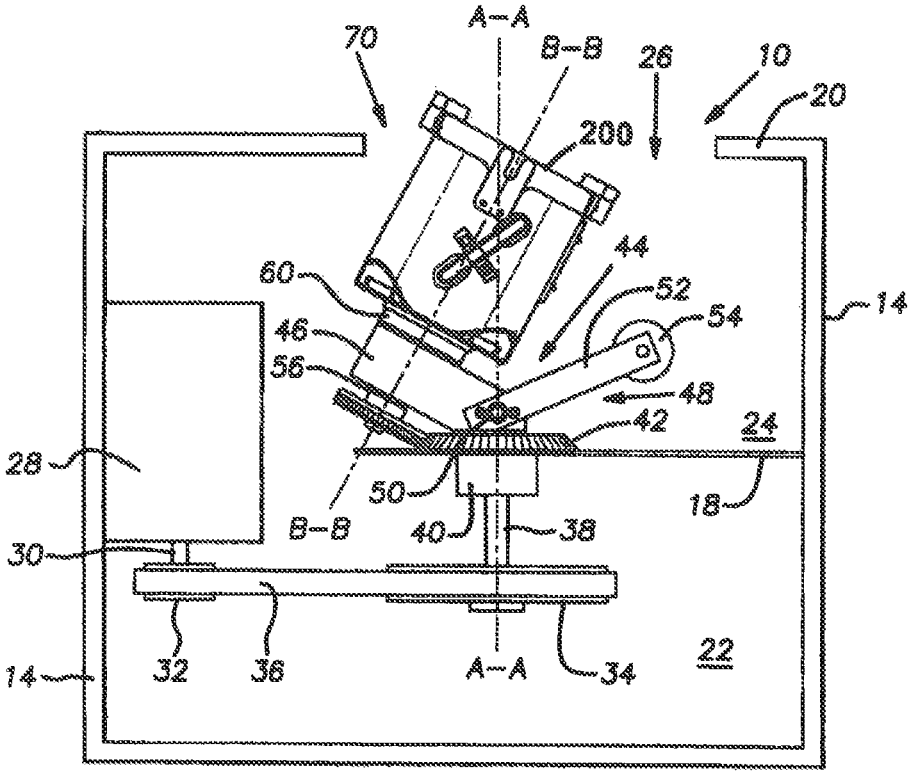
FIG. 1 is a side view of a mixing apparatus having a cabinet with a portion cut away to better show the interior thereof.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

As used herein, the term "conventional one gallon paint container" shall mean a cylindrical metal container for holding paint, having a diameter of about 6 10/16 inches, a height of about 7 11/16 inches, an interior volume of slightly greater than 1 U.S. gallon, and including a bail handle secured to a pair of mounting ears, each with a diameter of about ¾ of an inch. As used herein, the term "conventional quart paint container" shall mean a cylindrical metal container for holding paint, having a diameter of about 4 ⅛ inches, a height of about 4 13/16 inches and an interior volume of slightly greater than 1 quart.

The present invention is directed to an adaptor for holding a container in a bucket of a vortex mixing apparatus, wherein the container is smaller than the container the bucket is designed to hold. For example, in an embodiment disclosed herein, the adaptor is for holding a quart container in a bucket designed to hold a gallon container.

Referring now to FIG. 1, there is shown a vortex mixing apparatus 10, within which the adaptor of the present invention may be used. The mixing apparatus 10 is operable to mix a fluid dispersion, such as paint, that is disposed in either a cylindrical container or in a generally square container. For proper operation, the mixing apparatus 10 should be disposed on a substantially horizontal surface, and in the following description, it will be assumed that the mixing apparatus 10 is so disposed.

The mixing apparatus 10 includes a rectangular cabinet having upstanding side walls 14, a bottom wall 16, an access door (not shown), an intermediate wall 18 and an upper wall 20. The intermediate wall 18 divides the cabinet into a lower drive chamber 22 and an upper loading chamber 24. The access door closes an opening (not shown) that provides access to the drive chamber 22. The access door may be hinged to one of the adjacent side walls 14 so as to be pivotable between open and closed positions, or the access door may be removably disposed between the ends of two of the side walls 14. The upper wall 20 has an enlarged circular opening 26 formed therein, which provides access to the loading chamber 24. Although not shown, a hood may mounted to the cabinet, above the upper wall 20.

An electric motor 28 is mounted toward the rear of the cabinet and extends between the drive chamber 22 and the loading chamber 24. A rotor shaft 30 of the electric motor 28 extends downwardly and is disposed in the drive chamber 22. A motor sprocket 32 with teeth is secured to an end of the rotor shaft 30. The motor sprocket 32 is drivingly connected to a larger diameter drive sprocket 34 by an endless belt 36 having interior ribs. The drive sprocket 34 is secured to a lower end of a vertical drive shaft 38 that extends upwardly through a bearing mount 40 and into the loading chamber 24 through an opening (not shown) in the intermediate wall 18. In the loading chamber 24, the drive shaft 3$ extends through a central passage (not shown) in a pedestal 42 that is disposed on an upper side of the intermediate wall 18. An upper end of the drive shaft 38 is secured to a yoke 44 disposed in the loading chamber 24, above the pedestal 42. The bearing mount 40 is secured to the pedestal 42, with the intermediate wall 18 trapped in between. The bearing mount 40 has a plurality of bearings (not shown) disposed therein for rotatably supporting the drive shaft 38.

Figure 2:
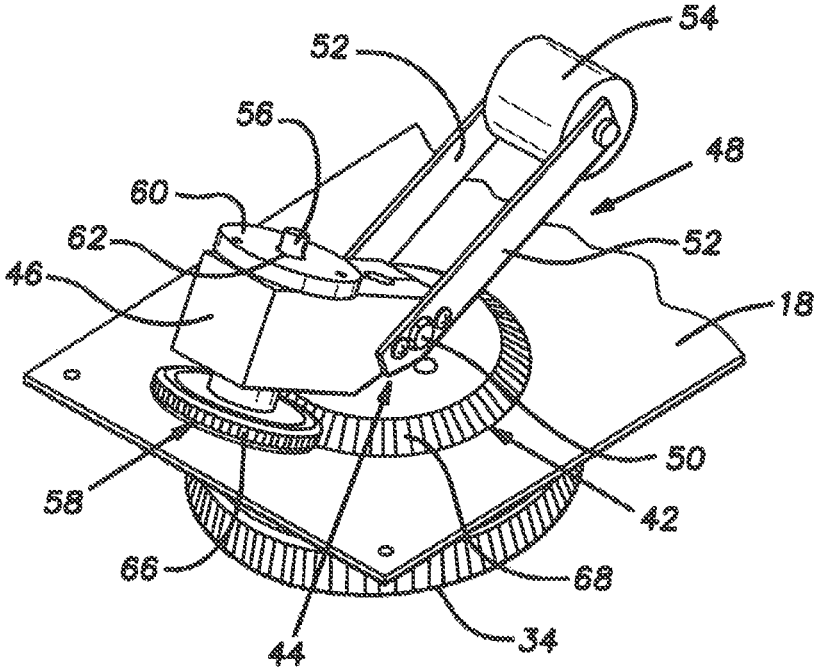
FIG. 2 is a top perspective view of a portion of the mixing apparatus.

Referring now also to FIG. 2, the yoke 44 includes a mounting arm 46 and a balancing arm 48 secured together at their inner ends by a bolt 50 that also secures the upper end of the drive shaft 38 to the yoke 44. The mounting arm 46 and the balancing arm 48 extend outwardly in opposing lateral directions and extend upwardly at acute angles from the vertical. The balancing arm 48 is bifurcated and includes a pair of spaced-apart elongated plates 52. A cylindrical counterweight 54 is secured between outer ends of the plates 52. The counterweight 54 balances the yoke 44 when a container of a fluid dispersion, such as paint, is mounted to the mounting arm 46, as will be described more fully below.

A mounting shaft 56 rotatably extends through a passage (not shown) in the mounting arm 46. Bearings (not shown) may be disposed in the passage to reduce friction between the mounting shaft 56 and the mounting arm 46. A drive wheel 58 is secured to a bottom portion of the mounting shaft 56, below the mounting arm 46, while a mounting support 60 is secured to an upper portion of the mounting shaft 56, above the mounting arm 46. The mounting support 60 may circular (as shown) or square. The mounting support 60 includes a center passage 62 through which an upper end of the mounting shaft 56 extends. A plurality of threaded bores 64 are formed in the mounting support 60 and are disposed around the center passage 62.

The drive wheel 58 has a side surface with gear teeth 66 formed therein which are in mechanical engagement with mating gear teeth 68 formed in a side surface on the pedestal 42. When the yoke 44 rotates about an axis A-A (shown in FIG. 1) extending through the drive shaft 38 (as will be described more fully below), the drive wheel 58 is moved around the pedestal 42. Since the gear teeth 66 in the side surface of the drive wheel 58 are in engagement with the gear teeth 68 in the side surface on the pedestal 42, the drive wheel 58 rotates around an axis B-B (shown in FIG. 1) extending through the mounting shaft 56 (as will he further described below). The axis B-B extends upwardly and preferably intersects the axis A-A at an acute angle of from about 20° to about 40°, more preferably at an angle of about 30°. If the mixing apparatus 10 is disposed on a substantially horizontal surface, the axis A-A extends substantially vertical, i.e., at about 90° from the horizontal.

The polarity of the electric motor 28 is set so as to rotate the yoke 44 about the axis A-A in a counter-clockwise direction, which causes the mounting support 60 to rotate about the axis B-B in a counter-clockwise direction.

It should be appreciated that in lieu of the drive wheel 58 and the pedestal 42 is being in positive mechanical engagement, the drive wheel 58 and the pedestal 42 may be in frictional engagement through the use of friction surfaces on the drive wheel 58 and the pedestal 42.

It should also be appreciated that the present invention is not limited to the particular mechanical arrangement described above for rotating the mounting support 60 about a plurality of axes. Other known mechanical arrangements may he utilized for rotating the mounting support 60 about a plurality of axes.

Figure 3:
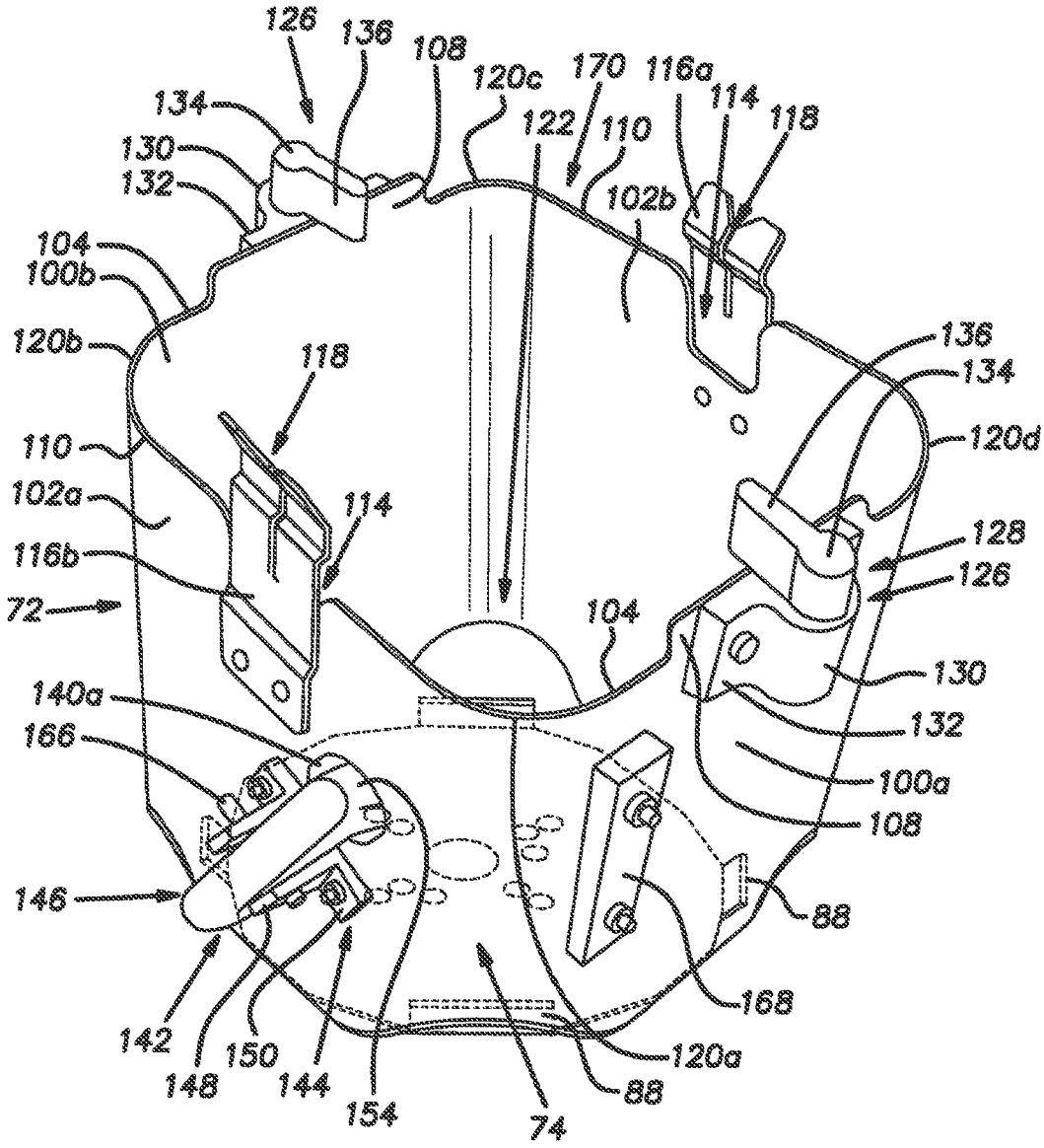
FIG. 3 is a top perspective view of a bucket of the mixing apparatus.
Figure 4:
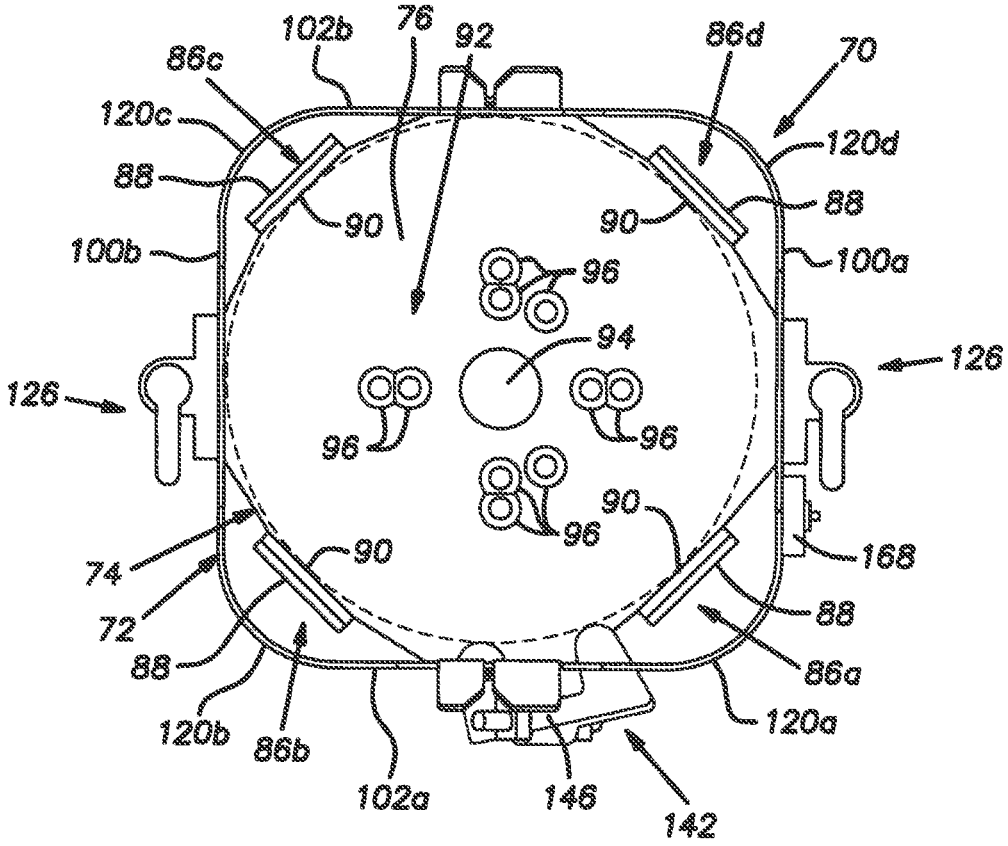
FIG. 4 is a top view of the bucket.

Referring now to FIGS. 3 and 4, there are shown a perspective top view and a top plan view of a bucket 70 for holding a container of a fluid dispersion, such as paint. The bucket 70 includes a retaining structure 72 joined to a base 74. The mixing apparatus 10 and the bucket 70 have the same structure and function as the mixing apparatus and bucket disclosed in the Huckby '949 application.

Referring now the base 74 is composed of metal and includes a floor plate 76 with a mount located on a bottom side thereof. The floor plate 76 has an outer periphery defined by connection regions disposed between flanged regions 86*a,b,c,d*. A rectangular tab or flange 88 extends upwardly and outwardly from each of the flanged regions 86*a,b,c,d*. With regard to the flanged regions 86*a,b,c,d*, the flanges 88 extend upwardly and outwardly from the major center edge. The flanges 88 are preferably integrally formed with the rest of the floor plate 76 and are bent upwardly at bends 90. The bends 90 help define the periphery of a cylinder receiving region 92 of the floor plate 76.

An axial opening 94 is positioned in the center of the floor plate 76 and extends through the base 74. A plurality of mounting bores 96 are disposed around the axial opening 94 and extend through the base 74 as well. One of the mounting bores 96 in each group can be aligned with one of the threaded bores 64 in the mounting support 60.

The axial opening 94 is not located in the center of the cylinder receiving region 92 of the floor plate 76, or, to put it another way, the cylinder receiving region 92 is not centered on the floor plate 76. Rather the cylinder receiving region 92 is offset toward the flanged region 86*c* . As a result, when a conventional one gallon paint container is disposed in the cylinder receiving region 92 of the floor plate 76, the vertical axis of the paint container is offset from the axis of rotation B-B in the direction of the flanged region 86*c*. Thus, the center of mass of the paint container and the paint disposed therein is offset from the axis of rotation B-B, toward the flanged region 86*c*.

The retaining structure 72 is comprised of a pair of parallel and substantially planar first walls 100*a,b* and a pair of parallel and substantially planar second walls 102*a,b*. Each of the first walls 100*a,b* is generally rectangular and includes a horizontal. top edge 104 and a beveled bottom edge 106 extending between vertical side portions. Each bottom edge 106 includes a horizontal center portion disposed between upwardly-sloping side portions. A generally rectangular flange 108 extends upwardly from a center portion of each top edge 104. Each of the second walls 102*a,b* is also generally rectangular and includes a horizontal top edge 110 and a beveled bottom edge 112 extending between vertical side portions. Each bottom edge 112 includes a horizontal center portion disposed between upwardly-sloping side portions, A generally rectangular slot 114 is formed in each of the second walls 102*a,b* and extends downwardly from the top edge 110. Spring clips 116 with downwardly-extending openings 118 are secured to the second walls 102*a,b* and are disposed over the slots 114. The spring clips 116 are operable to hold mounting ears and a bail handle of a conventional one gallon paint container.

The first and second walls 100*a,b*, 102*a,b* are arranged to provide the retaining structure 72 with a substantially square cross-section. Preferably, the side edges of the first walls 100*a,b* are joined to side edges of the second walls 102*a,b* at curved or rounded corners 120*a,b,c,d* (shown in FIG. 4). In this manner, the retaining structure 72 defines an inner void or holding space 122 having a cross section that is square with rounded corners. The beveled bottom edges 106, 112 of the first and second walls 100*a,b*, 102*a,b* permit the bucket 70 to freely rotate about the axis B-B without hitting the mounting arm 46 of the yoke 44.

The floor plate 76 of the base 74 is secured to the retaining structure 72. More specifically, the center portions of the bottom edges 106 of the first wails 100*a,b* are secured to the edges of the connection regions 80*a,c* by welding or other means, while the center portions of the bottom edges 112 of the second walls 102*a,b* are secured to the edges of the connection regions 80*b,d* by welding or other means. With the base 74 secured to the retaining structure 72 in this manner, the corner 120*a* is aligned with the flanged region 86*a*.

The interior distance between the first walls 100*a,b* and the interior distance between the second walls 102*a,b* are each about 6.865 inches. The corners 120*a,b,c,d*, however, are formed so as to reduce the distance between the centers of adjacent corners 120*a,b,c,d* to about 6.625 inches. In this regard, the corners 120*a,b,c,d* each have a radius of curvature of about 1.375 inches. As a result of the configuration of the corners 120*a,b,c,d*, the retaining structure 72 can snugly accommodate a square container having a width of about 6.625 inches, which corresponds to the width of a conventional one gallon paint container. In so accommodating such a square container, the retaining structure 72 only contacts the square container at the corners 120*a,b,c,d*, as will be further discussed below.

A pair of clamp assemblies 126 are secured to the rectangular flanges 108 of the first walls 100*a,b*. Each clamp assembly 126 comprises a clamping structure 128 and a casing 130 with an interior bore joined to a mounting plate 132. The mounting plates 132 are secured to the rectangular flanges 108 by press fit pins or other means. Each clamping structure 128 includes a head 134 secured to a top end of a rod (not shown). The rods are slidably disposed in the bores of the casings 130. In this manner, the clamping structures 128 are vertically movable between a contracted position, wherein the head 134 abuts the casing 130, and an extended position, wherein the head 134 is spaced above the casing 130. Bottom portions of the rods are secured to springs that are attached to the casings 130 and bias the clamping structures 128 toward their contracted positions. The heads 134 of the clamping structures 128 are provided with levers 136 for engaging a container disposed in the bucket 70.

A pair of elliptical openings 140*a,b* are formed in the second wall 102*a*. A holding guide 142 is secured to an exterior surface of the second wall 102*a*. The holding guide 142 includes a yoke 144 and a rocker 146. The yoke 144 comprises a pair of spaced-apart holding arms 148 extending outwardly from an attachment plate 150. The rocker 146 includes an elongated body 152 joined between enlarged first and second heads 154, 156. The rocker 146 is pivotally mounted between the arms 148 of the yoke 144, with the first head 154 aligned with the opening 140*a*, the second head 156 aligned with the opening 140*b* and the passage 160 in the pivot mount 158 aligned with the openings in the arms 148. As is described more fully in the Huckby '949 application, the holding guide 142 helps ensure that the handle of a square paint container is positioned in the corner 120*a* of the bucket 70 and helps prevent an upper portion of a conventional one gallon paint container from moving toward the second wall 102*a* when the bucket 70 is rotating.

A weight bar 168 is secured to the first wall 100*a*, toward the corner 120*a*. The weight bar 168 is positioned to extend longitudinally along the length of the corner 120*a*. The weight bar 168 and to a lesser extent the holding guide 142 comprise an added weight that increases the weight of the bucket 70 at the corner 120*a*, thereby shifting the center of mass of the bucket 70 toward the corner 120*a*. The amount of the added weight is selected so as to be substantially equal to the weight of paint displaced by an integral handle in a corner of a square paint container.

The bucket 70 is adapted for holding a conventional one gallon paint container, as well as a generally square paint container having a width of about 6 10/16 inches and an integral handle formed in a corner of a body thereof, such as the paint container described in the Application.

When the square paint container is disposed in the bucket 70, the paint container is supported on the flanges 88 and is spaced above the floor plate 76. In addition, the vertical axis of the paint container is aligned with the axial opening in the base 74. Thus, the vertical axis of the paint container is disposed coaxially with the axis B-B. Since the paint container is disposed coaxially with the axis B-B and since the center of mass of the paint container is disposed toward the front corner of the paint container (due to the paint displaced by the formation of the handle), the center of mass of the paint container is offset from the axis B-B and is disposed toward the corner 120*c*. The weight of the weight bar 168 (and the holding guide 142), however, are specifically selected to counterbalance this offset in the center of mass of the paint container.

When a conventional one gallon paint container is positioned in the bucket 70, the container supported on the floor plate 76 within the cylinder receiving region 92. Since, the conventional container is disposed in the cylinder receiving region 92, the vertical axis of the conventional container is offset from the axis of rotation B-B in the direction of the corner 120*c* (and the flanged region 86*c*), i.e., the vertical axis of the conventional container is parallel to, but is spaced from, the axis of rotation B-B. Thus, the center of mass of the conventional container and the paint disposed therein is offset from the axis of rotation B-B, toward the corner 120*c*. The weight of the holding guide 142 and the weight bar at the opposing corner 120*a*, however, counterbalance this offset It should be appreciated that the present invention is not limited to the bucket 70. Other known buckets may be utilized that can hold both a conventional one gallon paint container and a square paint container having a width of about 6 10/16 inches. Moreover, a conventional cylindrical bucket that can only hold a conventional one gallon paint container may also be utilized.

Figure 5:
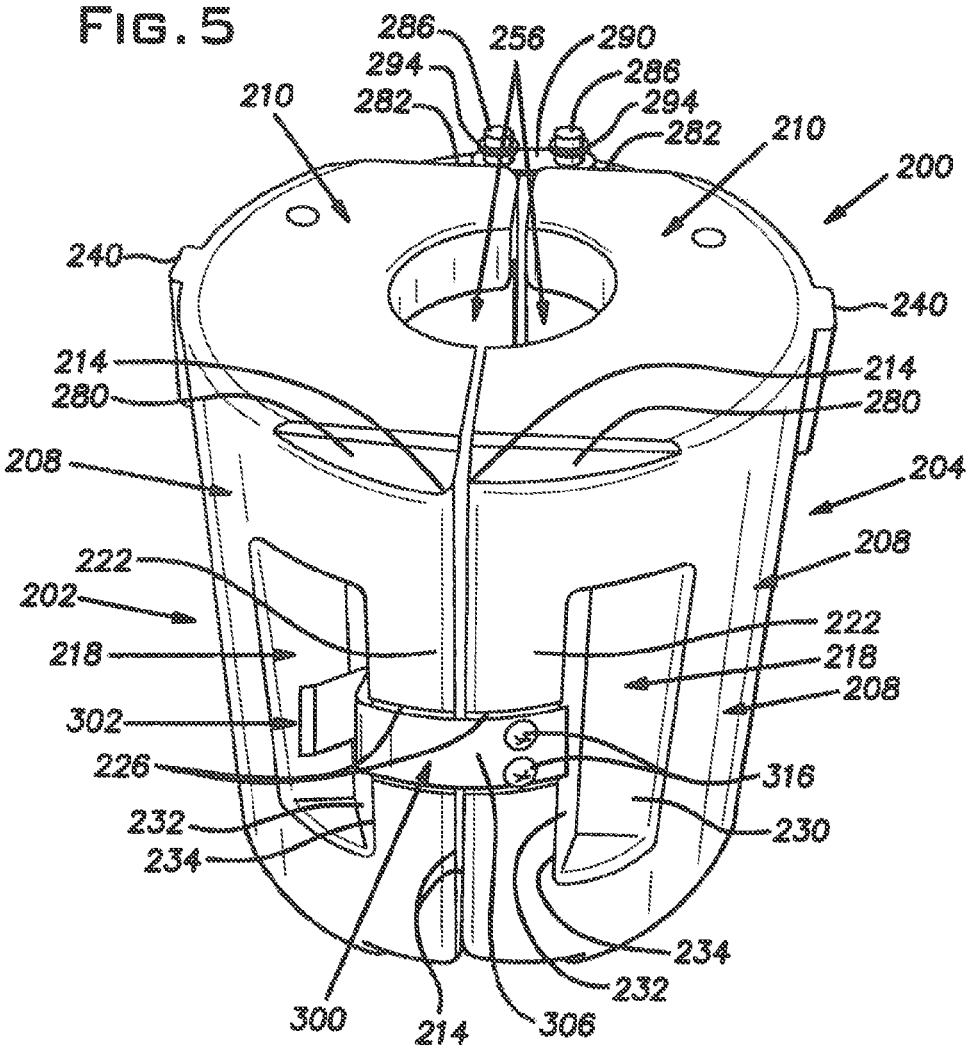
FIG. 5 is a top perspective view of an adaptor for use in the bucket of the mixing apparatus, wherein the adaptor is in a closed position
Figure 6:
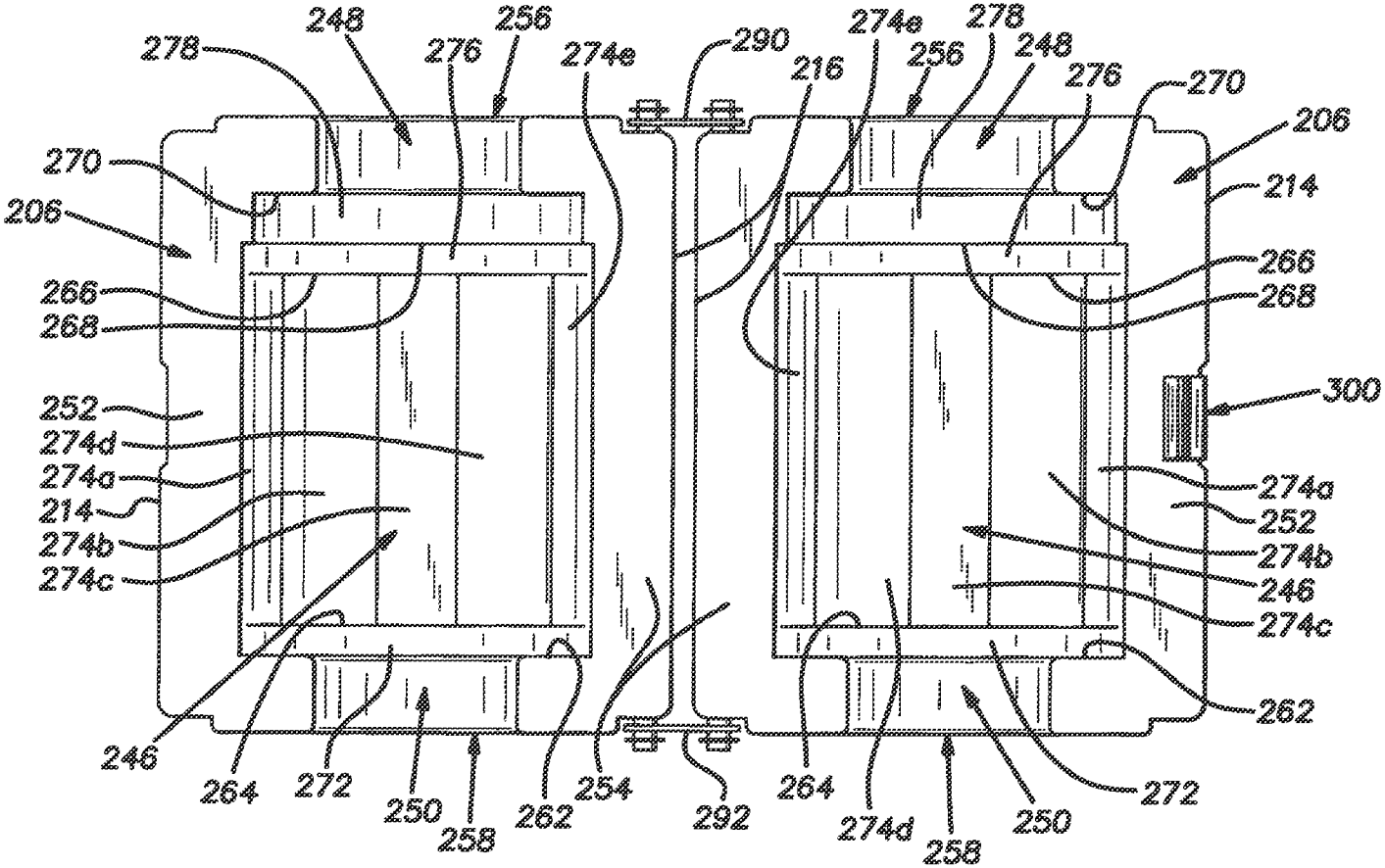
FIG. 6 is a front view of the adaptor in an open position, showing inside surfaces of first and second holding structures of the adaptor.

Referring now to FIGS. 5 and 6, there is shown an adaptor 200 embodied in accordance with the present invention. The adaptor 200 is comprised of a pair of first and second holding structures 202, 204, which are preferably mirror images of each other. Each of the first and second holding structures 202, 204 is composed of plastic, such as high density polyethylene, and is generally semi-cylindrical in shape. The first and second holding structures 202, 204 each include inner and outer surfaces 206, 208 and top and bottom end surfaces 210, 212.

In the description that follows, only one of the first and second holding structures 202, 204 will be described in detail, it being understood that the other one of the first and second holding structures 202, 204 has the same construction and features, except for being a mirror image.

The outer surface 208 is generally semi-cylindrical and is joined to the inner surface 206 at a front corner 214 and a rear corner 216. A front depression 218 and a rear depression 220 (shown in FIG. 7) are formed in the outer surface 208. The front and rear depressions 218, 220 have substantially the same shape. The front depression 218 is disposed toward the front corner 214, while the rear depression 220 is disposed toward the rear corner 216. A front interposing portion 222 of the outer surface 208 is disposed between the front depression 218 and the front corner 214, while a rear interposing portion of the outer surface 208 is disposed between the rear depression 220 and the rear corner 216. A central recess 226 is formed in the front interposing portion 222 and extends laterally between the front depression 218 and the front corner 214. The front and rear depressions 218, 220 are each partially defined by an inwardly-disposed major surface 230 and an inwardly-disposed and longitudinally-extending strip surface 232. The strip surface 232 forming the front depression 218 joins the front interposing portion 222 along a front bend 234 while the strip surface 232 forming the rear depression 220 joins the rear interposing portion along a rear bend. A longitudinally-extending securement groove 238 (shown in FIG. 7) is formed in each of the strip surfaces 232.

An ear 240 extends outwardly from the outer surface 208. The ear 240 is generally rectangular and includes a planar outer surface, a flat top end and an arcuate bottom end. The ear 240 is located at the top of the holding structure 202, 204, with the top end of the ear 240 being flush with the top end surface 210.

With particular reference now to FIG. 6, the inner surface 206 is substantially planar and extends between the front and rear corners 214, 216. An enlarged interior depression 246 is formed in the inner surface 206. The interior depression 246 includes a top end portion 248 that extends through the top end surface 210 and a bottom end portion 250 that extends through the bottom end surface 212. In this manner, the interior depression 246 divides the inner surface 206 into front and rear boundary surfaces 252, 254 and forms top and bottom openings 256, 258 in the top and bottom end surfaces 210, 212, respectively.

The interior depression 246 is defined by a plurality of vertically-extending interior surfaces and a plurality of horizontally-extending interior surfaces. The horizontally-extending interior surfaces include lower first and second support surfaces 262, 264, upper first and second holding surfaces 266, 268 and a top end surface 270, while the vertically-extending interior surfaces include an arcuate lower surface 272, a plurality of substantially planar central surfaces 274*a,b,c,d,e*, an arcuate upper rim surface 276 and an arcuate top surface 278. The first support surface 262 is semi-annular in to shape and is disposed below the second support surface 264. The second support surface 264 and the second holding surface 268 each have an arcuate inner edge and an angular outer edge that is defined by the central surfaces 274*a-e*. The upper rim surface 276 is disposed between the central surfaces 274*a-e* and the top surface 278.

The top and bottom end surfaces 210, 212 each have front and rear recessed portions 280, 282. A top opening of a bore 284 (shown in FIG. 7) extends through the rear recessed portion 282 of the top end surface 210, while a bottom opening of the bore 284 extends through the rear recessed portion 282 of the bottom end surface 212. The bore 284 extends longitudinally through the first holding structure 202, between the top and bottom openings, and is disposed toward the rear corner 216. A cylindrical rod 286, preferably composed of a metal, such as aluminum, is disposed in the bore 284. The rod 286 has top and bottom end portions that extend above the rear recessed portions 282. Circumferential grooves are formed in the top and bottom end portions.

The first and second holding structures 202, 204 are connected together for pivotal movement relative to each other along a vertical pivot axis disposed proximate to the rear corners 216 of the first and second holding structures 202, 204. More specifically, the first and second holding structure 202, 204 are connected together by upper and lower links 290, 292. Each of the upper and lower links 290, 292 is elongated and has outer end portions with openings formed therein. The upper link 290 is positioned such that the top end portions of the rods 286 extend through the openings in the upper link 290. A pair of bifurcated holding clips 294 are releasably secured to the top end portions over the upper link 290, with bifurcations of the holding clip 294 being disposed in opposing portions of the circumferential grooves of the top end portions. With the upper link 290 positioned in this manner, the upper link 290 is trapped between the holding clips 294 and the rear recessed portions 282, thereby preventing the upper link 290 from being removed. In a manner similar to the upper link 230, the lower link 292 is positioned such that the bottom end portions of the rods 286 extend through the openings in the lower link 292. Another pair of bifurcated holding clips 294 are releasably secured to the bottom end portions below the lower link 292, with the bifurcations of the holding clip 294 being disposed in opposing portions of the circumferential grooves of the bottom end portions. With the lower link 292 positioned to in this manner, the lower link 292 is trapped between the holding clips 294 and the rear recessed portions 282, thereby preventing the lower link 292 from being removed.

Figure 10:
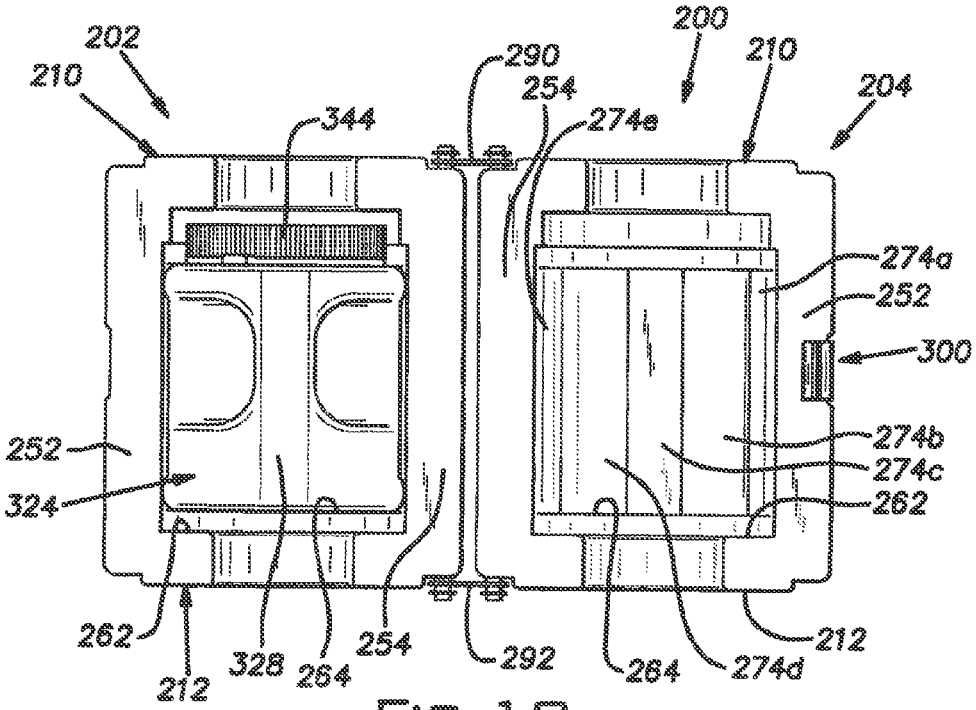
FIG. 10 shows a front view of the adaptor in the open position, with the rectangular paint container disposed in the first holding structure.
Figure 11:
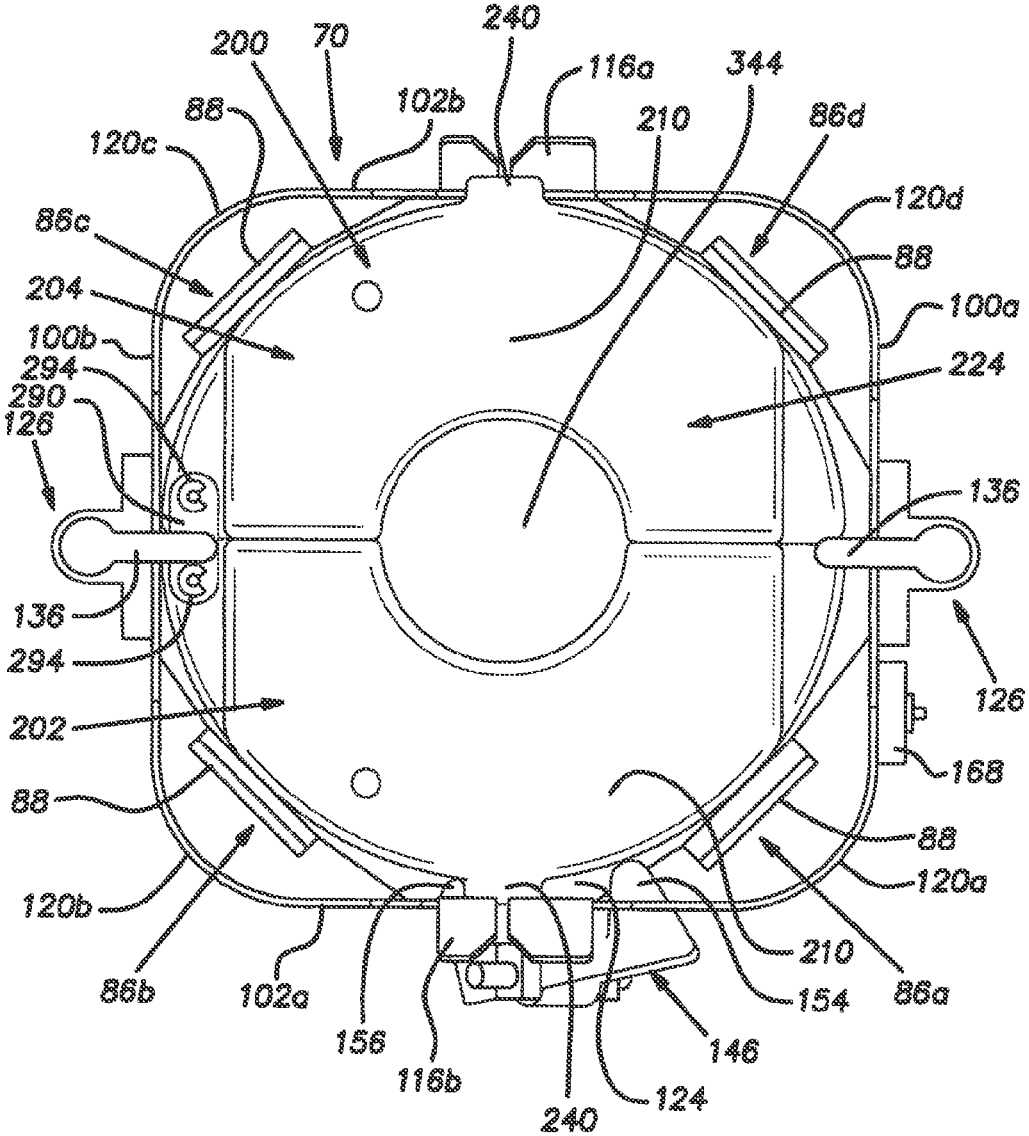
FIG. 11 shows a top view of the adaptor disposed in the bucket of the mixing apparatus.

The upper and lower links 290, 292 permit the first and second holding structures 202, 204 to be pivoted relative to each other between an open position (shown in FIGS. 6, 9 and 10) and a closed position (shown in FIGS. 5, 7 and 11). When the first and second holding structures 202, 204 are in the closed position, the interior depressions 246 are aligned with each other and cooperate to define a holding cavity 298. In addition, the front boundary surfaces 252 are aligned with each other and the rear boundary surfaces 254 are aligned with each other. The front boundary surfaces 252 are in contact with each other, but the rear boundary surfaces 254 are preferably separated by a slight gap to facilitate the pivotal movement of the first and second holding structures 202, 204, When the first and second holding structure 202, 204 are in the closed position, the adaptor 200 has a substantially cylindrical shape, with a diameter of about 6.4 inches, a height of about 7.4 inches and a distance between outer ends of the ears 240 of about 6.9 inches. In this manner, the adaptor 200 (when closed) has a diameter and a height that are a little less than the diameter and height of a conventional one gallon paint container, respectively.

Referring now to FIG. 7, there is shown a cut-away view of a bottom portion of the adaptor 200, with the first and second holding structure 202, 204 being disposed in the closed position. A bottom portion of the holding cavity 298 and a clasp 300 can be seen.

The clasp 300 is operable to hold the first and second holding structures 202, 204 together in the closed position. The clasp 300 is thin and is composed of a resilient metal, such as steel. The clasp 300 includes a head 302 joined at a first bend 304 to a body 306. The head 302 is J-shaped and includes an inner section joined at a second bend 308 to an outer section. The outer section has a beveled end portion 310. The body 306 is substantially rectangular and extends from the first bend 304 to a third bend 312, which joins the body 306 to a foot 314. The foot 314 is disposed substantially perpendicular to the body 306. A portion of the body 306 located toward the foot 314 is disposed in the central recess 226 of the second holding structure 204 and is secured therein by a pair of screws 316 that extend through openings in the body 306 and are threadably received in the second holding structure 204. With the body 306 so secured, the third bend 312 extends around the front bend 234 of the second holding structure 204 and the foot 314 is disposed against the strip surface 232 of the second holding structure 204. The head 302 and a portion of the body 306 disposed proximate thereto extend in a direction substantially perpendicular to the front boundary surface 252.

When the first and second holding structures 202, 204 are converging toward the closed position (as they are being moved from the open position to the closed position), an inner surface of the head 302 contacts and moves over the front corner 214 of the first holding structure 202 inside the central recess 226 thereof. The angle of the head 302 (relative to the body 306) acts as a cam surface, which forces the clasp 300 to bend forwardly so as to permit the head 302 to pass over the front interposing portion of the first holding structure 202 and to enter into the front depression 218 of the first holding structure 202. The amount of bending of the clasp 300 is dependent on the relative positioning of the first and second holding structures 202, 204 as they are being moved together, with the greatest bending occurring when the first holding structure 202 is held slightly forward of the second holding structure 204 and the least amount of bending occurring when the first holding structure 202 is held slightly rearward from the second holding structure 204. When the head 302 is disposed in the front depression 218 and the first and second holding structures 202, 204 are aligned, the second bend 308 moves into the securement groove 238, thereby releasably securing the first and second holding structures 202, 204 together in the closed position. In order to release the first and second holding structures 202, 204 from each other so that they can be moved to the open position, the beveled end portion 310 is pulled outwardly to move the second bend 308 out of the securement groove 238.

The holding cavity 298 includes a cylindrical holding region 318 disposed within and comprising a portion of a rectangular holding region 320. The cylindrical holding region 318 is at least partially defined by the first support surfaces 262, the second holding surfaces 268, the lower surfaces 272 and the upper rim surfaces 276 of the first and second holding structures 202, 204. The cylindrical holding region 318 has a diameter between the lower surfaces 272 of about 4.255 inches, which is slightly greater than the diameter of a conventional one quart paint container, and has a height between the first support surfaces 262 and the second holding surfaces 268 of about 4.885 inches, which is slightly greater than the height of a conventional one quart paint container. In this manner, the cylindrical holding region 318 is adapted to hold a conventional one quart paint container so as to preclude significant movement of the paint container within the holding cavity 298 during a paint mixing process, wherein the adaptor 200 with the paint container is disposed within the bucket 70 and the bucket 70 is rotated around the A-A and B-B axes pursuant to the operation of the mixing apparatus 10.

The rectangular holding region 320 is at least partially defined by the second support surfaces 264, the first holding surfaces 266 and the central surfaces 274*a-e* of the first and second holding structures 202, 204. The rectangular holding region 320 includes opposing substantially planar portions defined, on one side, by the central surfaces 274*a* of the first and second holding structures 202, 204 and, on the other side by the central surfaces 274*e* of the first and second holding structures 202, 204, and opposing angular portions defined, on one side, by the central surfaces 274*b-d* of the first holding structure 202 and, on the other side, by the central surfaces 274*b-d* of the second holding structure 202. In this manner, the rectangular holding region 320 has two angular portions, one in each of the first and second holding structures 202, 204. The rectangular holding region 320 has a width between the central surfaces 274*c* of the first and second holding structures 202, 204 of about 4.355 inches, a width between the central surfaces 274*a* of the first and second holding structures 202, 204 and the central surfaces 274*e* of the first and second holding structures 202, 204 of about 5.705 inches and a height between the second support surface 264 and the first holding surface 266 of about 4.315 inches. The rectangular holding region 320 is adapted to hold a one quart paint container having a body with a rectangular or generally rectangular cross-section (hereinafter a "rectangular paint container") with a width in at least one direction about the same as a conventional quart container, so as to preclude significant movement of the rectangular paint container within the holding cavity 298 during a paint mixing process, wherein the adaptor 200 with the rectangular paint container is disposed within the bucket 70 and the bucket 70 is rotated around the A-A and B-B axes pursuant to the operation of the mixing apparatus 10.

An example of a rectangular paint container that can be held in the rectangular holding region 320 is shown in FIG. 8 and is designated with the reference number 324. The rectangular paint container 324 comprises a plastic body 326 defining an interior volume for holding a fluid dispersion, such as architectural paint. The body 326 is preferably blow molded from high density polyethylene and has a generally rectangular shape with a plurality of vertically-extending walls, including a narrow rear wall 328, a pair of angled walls 330, a front wall (not shown) and a pair of opposing main walls 334. The rear wall 328 is joined between rear portions of the angled walls 330. Front portions of the angled walls 330 are joined to rear portions of the main walls 334 and are disposed at obtuse angles thereto. The front wall is joined between front portions of the main walls 334 and is disposed opposite the rear wall 328. In this manner, the body 326 has an angular rear portion and a generally planar front portion.

The body 326 also includes a bottom wall (not shown) and a top wall 336 with an opening formed therein. A collar (not shown) with an external thread is disposed around the opening in the top wall 336 and extends upwardly therefrom. The collar terminates in an upper rim defining an access opening, which has a diameter of about 3 1/16 inches.

The body 326 further has a plurality of inner walls 338 defining a handle passage 340 that extends through the angled walls 330, thereby forming a handle 342 comprising the rear wall 328. The handle passage 340 and the handle 342 are integrally formed with the rest of the body 326 during the blow molding of the body 326. Thus, the handle 342 is an integral handle formed in the body 326 of the rectangular paint container 324.

A lid 344 is provided for closing the access opening in the collar. The lid comprises 344 a circular end wall 346 and a cylindrical side wall 348 with a series of vertical ridges formed therein. A pair of grip lugs 350 extend radially outward from the side wall 348. The side wall 348 has an internal thread (not shown) for engaging the thread of the collar to threadably secure the lid 344 to the collar.

The body 326 of the rectangular paint container 324 has a width between the main walls 334 of about 4 1/8 inches, a length between the front wall and the rear wall 328 of about 4 1/2 inches, and a height between the top wall 336 and the bottom wall of about 4 1/4 inches. In this manner, the rectangular paint container 324 has a width in at least one to direction that is about the same as the width of a conventional quart paint container.

Both of the angular portions of the rectangular holding region 320 of the adaptor 200 are adapted to receive the angular rear portion of the body 326 of the rectangular paint container 324. As a result, the rectangular paint container 324 can be positioned in the rectangular holding region 320, with the angular rear portion of the body 326 disposed either in the angular portion in the first holding structure 202 or in the angular portion in the second holding structure 204, i.e., the handle 342 of the rectangular paint container can be disposed in either the first holding structure 202 or the second holding structure 204. This duality facilitates the loading of the rectangular paint container 324 into the adaptor 200. It should be appreciated that the rectangular holding region 320 of the adaptor 200 can also hold a modified version of the rectangular paint container 324, wherein the narrow rear wail 328 and the angled walls 330 are replaced with a single large rear wall disposed between the main walls 334 and opposite the front wall. In such a container, the body would have a substantially square cross-section. An integral handle may or may not be formed in the body of such a container.

Figure 9:
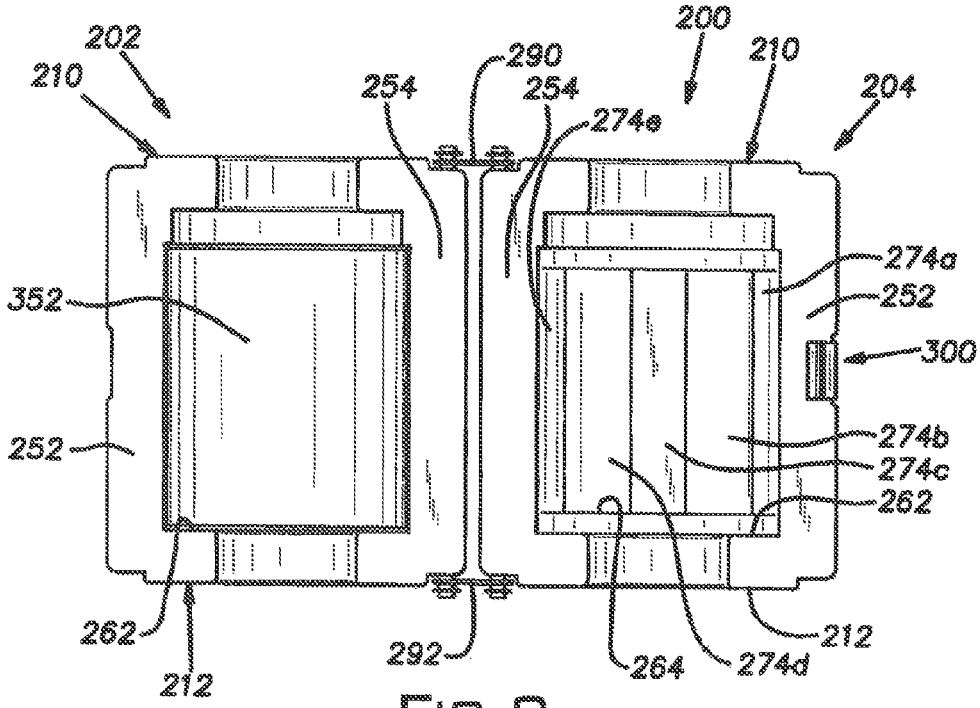
FIG. 9 shows a front view of the adaptor in the open position, with a cylindrical paint container disposed in the first holding structure.

Referring now to FIG. 9, the adaptor 200 is shown in the open position, with a conventional one quart paint container 352 disposed in the interior depression 246. A bottom end of the paint container 352 is supported on the first support surface 262 and a top end of the paint container 352 is disposed in at least close proximity to the second holding surface 268. When the adaptor 200 is moved to the closed position, the paint container 352 will be held in the cylindrical holding region 318 and will be supported on both the first support surface 262 of the first holding structure 202 and the first support surface 262 of the second holding structure 204.

Referring now to FIG. 10, the adaptor 200 is shown in the open position, with the rectangular paint container 324 disposed in the interior depression 246. A bottom end of the rectangular paint container 324 is supported on the second support surface 264 and the top wall 336 of the paint container 324 is disposed in at least close proximity to the first holding surface 266. When the adaptor 200 is moved to the closed position, the rectangular paint container 324 will be held in the rectangular holding region 320 and will he supported on both the second support surface 264 of the first holding structure 202 and the second support surface 264 of the second holding structure 204.

Referring now to FIG. 11, the adaptor 200 is shown in the closed position and disposed in the bucket 70. The adaptor 200 is supported on the floor plate 76 within the cylinder receiving region 92. The first and second heads 154, 156 of the rocker 146 are disposed in the gap 124 and are positioned against or in close proximity to the adaptor 200, thereby preventing an upper portion of the adaptor 200 from moving toward the second wall 102*a* when the bucket 70 is rotating. The levers 136 are disposed over the top end surface 210 of the adaptor 200. In this manner, the adaptor 200 is trapped between the floor plate 76 of the base 74 and the levers 136, thereby securing the adaptor 200 in the bucket 70. The ears 240 of the adaptor 200 are held by the spring clips 116, thereby further securing the adaptor 200 in the bucket 70.

Referring back to FIG. 1, the bucket 70 is secured to the mounting support 60 by disposing the bucket 70 on the mounting support 60 such that the mounting shaft 56 extends through the axial opening 94 in the base 74 and the mounting bores 96 are aligned with the bores 64 in the mounting support 60. Bolts (not shown) are inserted through the bores 96 and are threaded into the bores 64. With the bucket 70 secured to the mounting support 60 in the foregoing manner, the bucket 70 extends upwardly, through the circular opening 26 in the cabinet, thereby making the bucket 70 readily accessible to an operator. The central axis of the bucket 70 is collinear with the axis B-B and, thus, preferably intersects axis A-A at an angle of from about 20° to about 40°, more preferably at an angle of about 30°.

The adaptor 200 is especially suited for permitting paint in the rectangular paint container 324 to be mixed in the mixing apparatus 10. Typically, the mixing apparatus 10 is located in a retail store where paint is sold. A paint manufacturer supplies the retail store with the rectangular paint container 324 filled with a base paint composition. When a customer selects a particular color for paint, an employee at the retail store determines the required amount of tinting concentrate(s) for producing the selected color. The employee then unscrews the lid 344 from the collar and adds the tinting concentrates) to the base paint composition disposed in the body 326 of the rectangular paint container 324. The employee then tightly screws the lid 344 back onto the collar and places the rectangular paint container 324 in one of the interior depressions 246 of the first and second holding structures 202, 204 when they are in an open position. One or both of the first and second holding structures 202, 204 are then manipulated by the employee to place the first and second holding structures 202, 204 in the closed position and to insert the second bend 308 of the clasp 300 into the securement groove 238 of the first holding structure 202. The employee then places the adaptor 200 in the bucket 70 so as to be positioned as described above. With the adaptor 200 securely disposed in the bucket 70 as shown in FIG. 1, the employee activates a start switch or button that provides the electric motor 28 with power, which causes the rotor shaft 30 and, thus, the motor sprocket 32 to rotate. The belt 36 transfers the rotation of the motor sprocket 32 to the drive sprocket 34, thereby causing the drive sprocket 34 and, thus, the drive shaft 38 to rotate. The rotation of the drive shaft 38 causes the yoke 44 to rotate about the axis A-A in a counter-clockwise direction which, in turn, causes the drive wheel 58 and the mounting support 60 to rotate about the axis B-B in a counter-clockwise direction. As a result, the bucket 70 and, thus, the adaptor 200 and the rectangular paint container 324 are simultaneously rotated about the axis A-A and the axis B-B, thereby mixing the paint in the rectangular paint container 324.

While the invention has been shown and described with respect to particular embodiments thereof, those embodiments are for the purpose of illustration rather than limitation, and other variations and modifications of the specific embodiments herein described will be apparent to those skilled in the art, all within the intended spirit and scope of the invention. Accordingly, the invention is not to be limited in scope and effect to the specific embodiments herein described, nor in any other way that is inconsistent with the extent to which the progress in the art has been advanced by the invention.

What is claimed is:

1. A method of mixing paint, the method comprising the steps of:

(a.) placing a first container in a cavity of an adaptor, the adaptor having:

an interior including first and second lower support surfaces disposed in planes perpendicular to a longitudinal axis;

wherein the first lower support surface is disposed at a different elevation than the second lower support surface; and wherein the interior of the adaptor includes first and second upper support surfaces disposed in planes perpendicular to the longitudinal axis;

wherein the first upper support surface is disposed at a different elevation than the second upper support surface;

so that the first container is supported on the first lower surface;

(b.) disposing the adaptor with the first container within a bucket; and (c.) rotating the bucket and the adaptor with the first container about at least one axis;

(d.) removing the adaptor with the first container from the bucket;

(e.) removing the first container from the cavity of the adaptor;

(f.) placing a second container in the cavity of the adaptor so that the second container is supported on a second lower surface.

2. The method of claim 1, further comprising the steps of:

(g.) placing a third container in the bucket;

(h.) rotating the bucket and the third container about the at least one axis; and (i.) removing the third container from the bucket.

3. The method of claim 2, wherein steps (g.), (h.) and (i.) are performed after step (e.).

4. The method of claim 2, further comprising the steps of:

(j.) placing a fourth container in the bucket;

(k.) rotating the bucket and the fourth container about the at least one axis; and (l.) removing the fourth container from the bucket.

5. The method of claim 4, wherein steps (j.), (k.) and (l.) are performed before step (a.).

6. The method of claim 4, wherein the first container holds about a quart of first paint, the second container holds about a quart of second paint, the third container holds about a gallon of third paint and the fourth container holds about a gallon of fourth paint.

* * * * *